US005852888A

United States Patent [19]

Cornelius

[11] Patent Number: 5,852,888

[45] Date of Patent: Dec. 29, 1998

[54] APPARATUS FOR PROTECTING A BASE OF A BUCKET OF AN EARTH WORKING MACHINE

[75] Inventor: Erwin D. Cornelius, Bloomington, Ill.

[73] Assignee: Caterpillar Inc., Peoria, Ill.

[21] Appl. No.: 747,097

[22] Filed: Nov. 8, 1996

[51] Int. Cl.[6] ..... E02F 9/28

[52] U.S. Cl. ..... 37/457; 37/450; 37/451; 403/378; 172/772.5; 172/753

[58] Field of Search ..... 37/446, 447, 449, 37/450, 451, 452, 453, 454, 455, 456, 457, 458, 459; 172/772, 772.5, 753, 713; 403/378, 379

[56] References Cited

U.S. PATENT DOCUMENTS

| | | | |
|---|---|---|---|
| 3,121,289 | 2/1964 | Eyolfson | 37/456 |
| 3,511,126 | 5/1970 | Watts | 85/8.3 |
| 3,520,224 | 7/1970 | Hensley et al. | 37/457 X |
| 3,650,053 | 3/1972 | Baer | 37/142 |
| 3,774,324 | 11/1973 | Lafond | 37/457 |
| 3,952,433 | 4/1976 | Heinold et al. | 37/457 |
| 4,192,089 | 3/1980 | Schwappach | 37/457 |
| 4,446,638 | 5/1984 | Novotny et al. | 37/142 A |
| 4,727,663 | 3/1988 | Hahn | 37/142 A |
| 5,068,986 | 12/1991 | Jones | 37/457 |
| 5,075,986 | 12/1991 | Smith et al. | 37/142 A |
| 5,144,762 | 9/1992 | Robinson | 37/457 |
| 5,438,774 | 8/1995 | Fletcher et al. | 37/456 |
| 5,452,529 | 9/1995 | Neuefeldt et al. | 37/455 |
| 5,465,512 | 11/1995 | Livesay et al. | 37/457 |
| 5,469,648 | 11/1995 | Jones et al. | 37/457 |
| 5,617,655 | 4/1997 | Launder et al. | 37/457 |
| 5,638,621 | 6/1997 | Keech et al. | 37/456 X |

FOREIGN PATENT DOCUMENTS

| | | | |
|---|---|---|---|
| 2639989 | 4/1982 | Germany | E02F 9/28 |

*Primary Examiner*—Michael J. Carone
*Assistant Examiner*—Victor Batson
*Attorney, Agent, or Firm*—Maginot, Addison, & Moore

[57] ABSTRACT

An apparatus for protecting a base edge of a bucket of an earth working machine includes a fixed component secured to the base edge of the bucket, the fixed component having a first aperture extending therethrough. The apparatus also includes a protection member having a second aperture extending therethrough, wherein (1) the protection member is positioned relative to the fixed component such that the first aperture and the second aperture align to form a passageway having a first end and a second end, the passageway defining a passageway sidewall extending between the first end and the second end, (2) the protection member has a first notch defined therein, (3) the first notch is defined in the passageway sidewall, and (4) the first notch is spaced apart from both the first end and the second end of the passageway sidewall. The apparatus further includes a bearing member having a first tab extending therefrom, wherein the bearing member is positioned within the passageway such that the first tab is positioned within the first notch.

18 Claims, 6 Drawing Sheets

APPARATUS FOR PROTECTING A BASE OF A BUCKET OF AN EARTH WORKING MACHINE

BACKGROUND OF THE INVENTION

The present invention relates generally to an earth working machine, and more particularly to an apparatus for protecting a base edge of a bucket of an earth working machine.

Earth working machines, or the like, typically have a bucket for moving or excavating dirt or other types of material. Buckets are constructed to include a base edge.

In order to facilitate the excavating process, a number of tooth assemblies are attached to the base edge. The base edge also has a number of edge protector assemblies attached thereto between the tooth assemblies. The edge protector assemblies protect the base edge from the wear and tear encountered during the excavating process. The protection of the base edge extends the life of the bucket and reduces the maintenance cost of the earth working machine.

Many edge protector assemblies have heretofore been secured to the base edge utilizing a mechanism that includes the following components: (1) a fixed component having a hole defined therein which is welded to the base edge, and (2) a protection member, also having a hole therein, positioned over the fixed component such that the hole in the fixed component and the hole in the protection member are aligned to form a passageway. The fixed component and the protection member are secured to each other by positioning a pin member locked to a bearing member into the passageway.

One disadvantage of the above-described arrangement is that a portion of the securement mechanism for holding the bearing member and pin member stationary relative to the protection member is positioned such that it is constantly exposed to the wear and tear experienced by the protection member during the excavating process. As a result, the pin member and bearing member must be replaced relatively frequently, thereby adding to the maintenance cost of the earth working machine.

An additional disadvantage of the aforementioned securement mechanism is that the pin member and bearing member tend to move within the passageway relative to the protection member. The movement of the pin member and bearing member cause wear within the securement mechanism and thus also contributes to the maintenance cost of the earth working machine.

A further disadvantage of the above described securement mechanism is that the pin member and bearing member tend to move relative to each other within the passageway. This type of movement may cause the pin member to unlock from the bearing member and result in the protection member being inadvertently separated from the base edge of the bucket.

It would therefore be desirable to provide an apparatus for protecting a base edge of a bucket that decreases the maintenance cost of a earth working machine. It would further be desirable to provide an apparatus for protecting a base edge of a bucket that allows a greater amount of wear on the apparatus before the components thereof have to be replaced. It would also be desirable to provide an apparatus for protecting a base edge of a bucket wherein the components of the apparatus are protected from the wear and tear of the excavating process. It would also be desirable to provide an apparatus for protecting a base edge of a bucket that substantially reduces the movement of the pin member and the bearing member relative to the protection member. It would also be desirable to provide an apparatus for protecting a base edge of a bucket that substantially reduces the movement of the pin member relative to the bearing member.

SUMMARY OF THE INVENTION

The above and other objects, features, and advantages of the present invention will become apparent from the following description and the attached drawings.

In accordance with one embodiment of the present invention an apparatus for protecting a base edge of a bucket of an earth working machine is provided. The apparatus includes a fixed component secured to the base edge of the bucket, the fixed component having a first aperture extending therethrough. The apparatus also includes a protection member having a second aperture extending therethrough, wherein (1) the protection member is positioned relative to the fixed component such that the first aperture and the second aperture align to form a passageway having a first end and a second end, the passageway defining a passageway sidewall extending between the first end and the second end, (2) the protection member has a first notch defined therein, (3) the first notch is defined in the passageway sidewall, and (4) the first notch is spaced apart from both the first end and the second end of the passageway sidewall. The apparatus further includes a bearing member having a first tab extending therefrom, wherein the bearing member is positioned within the passageway such that the first tab is positioned within the first notch.

In accordance with another embodiment of the present invention there is provided an earth working machine. The earth working machine includes a bucket and a fixed component secured to the bucket, the fixed component having a first aperture extending therethrough. The earth working machine also includes a protection member having a second aperture extending therethrough, wherein (1) the protection member is positioned relative to the fixed component such that the first aperture and the second aperture align to form a passageway having a first end and a second end, the passageway defining a passageway sidewall extending between the first end and the second end, (2) the protection member has a first notch defined therein, (3) the first notch is defined in the passageway sidewall, and (4) the first notch is spaced apart from both the first end and the second end of the passageway sidewall. The earth working machine further includes a bearing member having a first tab extending therefrom, wherein the bearing member is positioned within the passageway such that the first tab is positioned within the first notch.

In accordance with still another embodiment of the present invention there is provided a fastening assembly for securing an attachment member to a base edge of a bucket of an earth working machine, with (1) the bucket having a fixed component secured thereto, (2) the fixed component having a first aperture defined therein, and (3) the attachment member having a second aperture defined therein. The fastening assembly includes a bearing member positionable within the first aperture and the second aperture, wherein the bearing member has (1) has a first end and a second end, (2) a tab extending therefrom at a location intermediate the first end and the second end of the bearing member, and (3) a cavity formed therein. The fastening assembly also includes a pin member positionable within the first aperture and the second aperture, wherein (1) the pin member has a key extending therefrom which is positioned within the cavity of the bearing member, (2) an external sidewall of the pin member contacts both a first internal sidewall of the first aperture and a second internal sidewall of the second aperture when the pin member is positioned within the first aperture and the second aperture, (4) the external sidewall of the pin member defines a linear surface which contacts both the first internal sidewall of the first aperture and the second internal sidewall of the second aperture.

It is therefore an object of this invention to provide a new and useful apparatus for protecting a base edge of a bucket of an earth working machine.

It is a further object of this invention to provide an improved apparatus for protecting a base edge of a bucket of an earth working machine.

It is another object of this invention to provide a new and useful apparatus for excavating material.

It is yet another object of this invention to provide an improved apparatus for excavating material.

It is still another object of this invention to provide an apparatus for protecting a base edge of a bucket of an earth working machine that decreases the maintenance cost of an earth working machine.

It is yet another object of this invention to provide an apparatus for protecting a base edge of a bucket of an earth working machine that allows a greater amount of wear on the apparatus before the components thereof have to be replaced.

It is still another object of this invention to provide an apparatus for protecting a base edge of a bucket of an earth working machine that protects the bearing member and the notch from wear and tear during the excavation process.

It is yet another object of this invention to provide an apparatus for protecting a base edge of a bucket of an earth working machine that substantially reduces the movement of the pin member and the bearing member relative to the protection member during the excavation process.

It still another object of this invention to provide an apparatus for protecting a base edge of a bucket of an earth working machine that substantially reduces the movement of the pin member relative to the bearing member.

DETAILED DESCRIPTION OF THE PREFERRED EMBODIMENT

Figure 1:
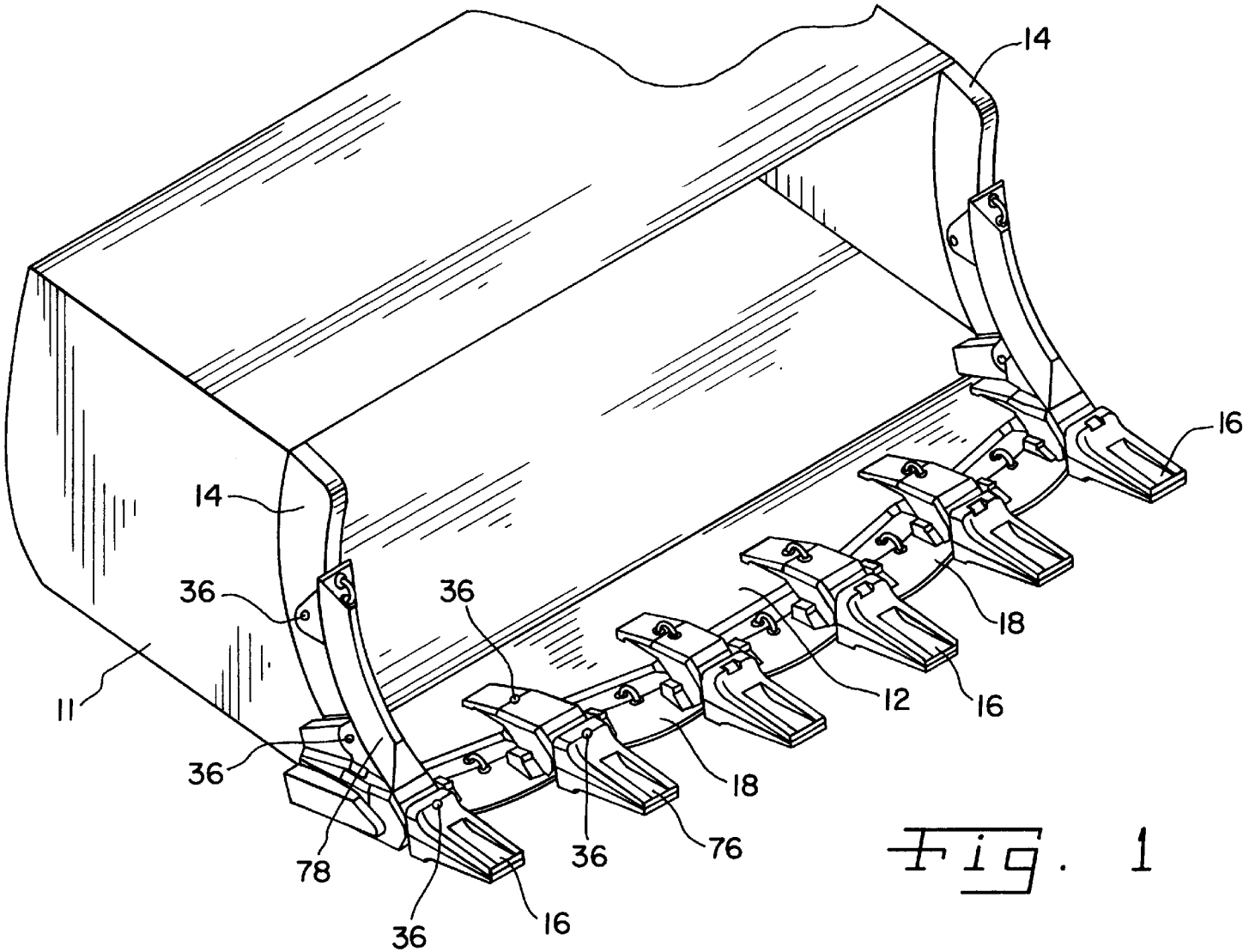
FIG. 1 is a perspective view of a bucket of an earth working machine having a number of support arms, tooth assemblies and edge protector assemblies attached thereto, which incorporates the features of the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a metallic bucket assembly 10 which incorporates the features of the present therein. The bucket assembly 10 includes a bucket 11 which is partially shown in FIG. 1. The bucket 11 is used on an earth working machine to excavate material in a known manner. Bucket assembly 10 includes a base edge 12, two support arms 14 and a number of tooth assemblies 16 attached to the base edge 12. Bucket assembly 10 also includes a number of edge protector assemblies 18 interposed between tooth assemblies 16, and secured to base edge 12.

Figure 2:
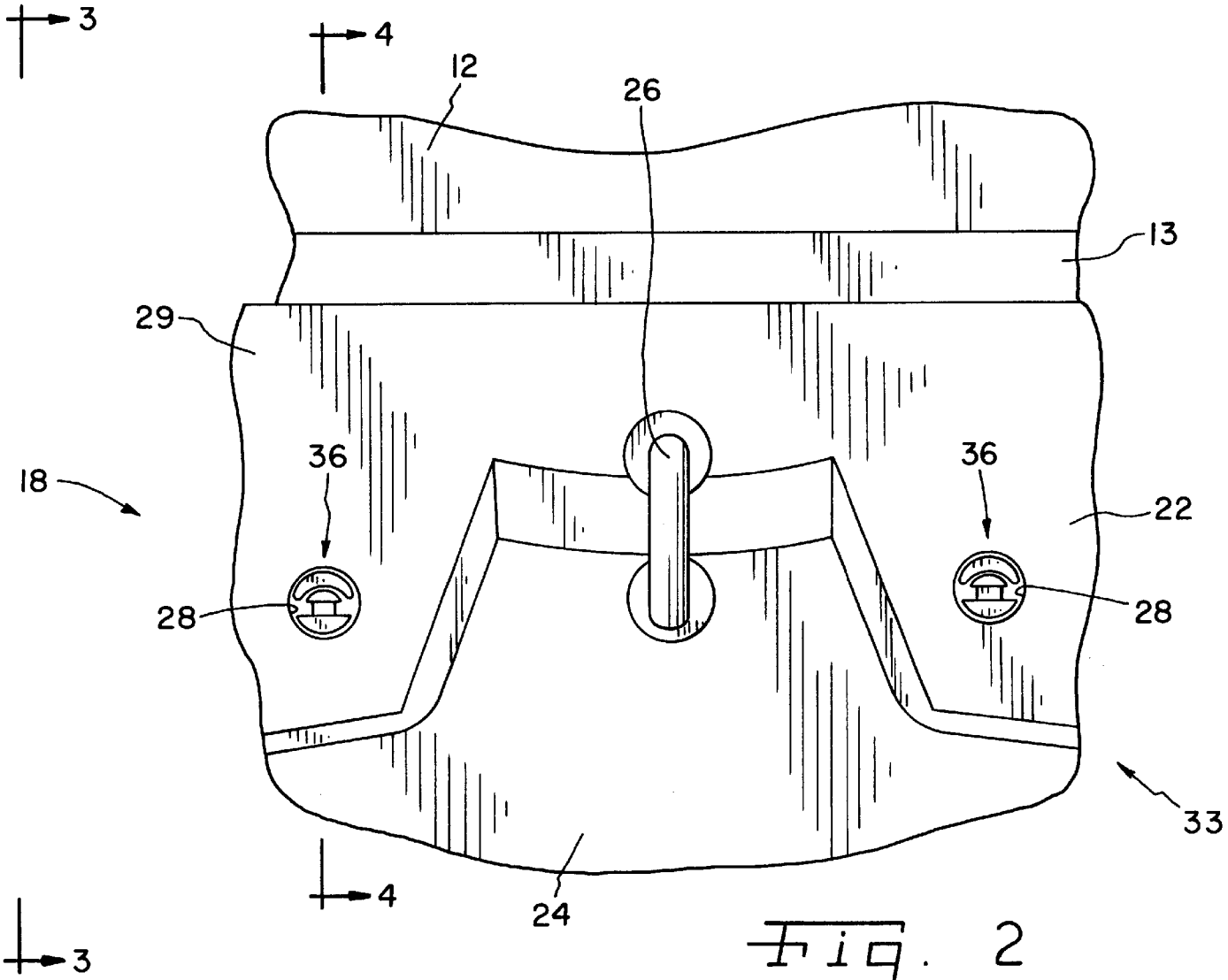
FIG. 2 is an enlarged top elevational view of one of the edge protector assemblies shown in FIG. 1, with a portion of the base edge shown for clarity of description.
Figure 3:
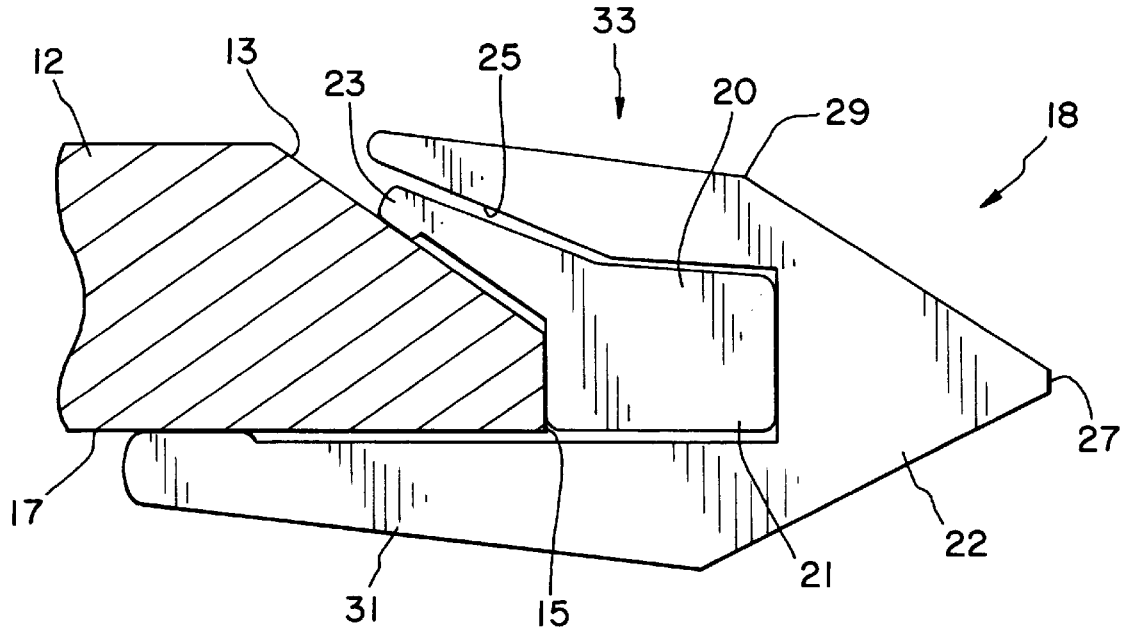
FIG. 3 is a side elevational view of the edge protector assembly taken along line 3—3 of FIG. 2 as viewed in the direction of the arrows (note: the hood portion is removed for clarity of description)
Figure 4:
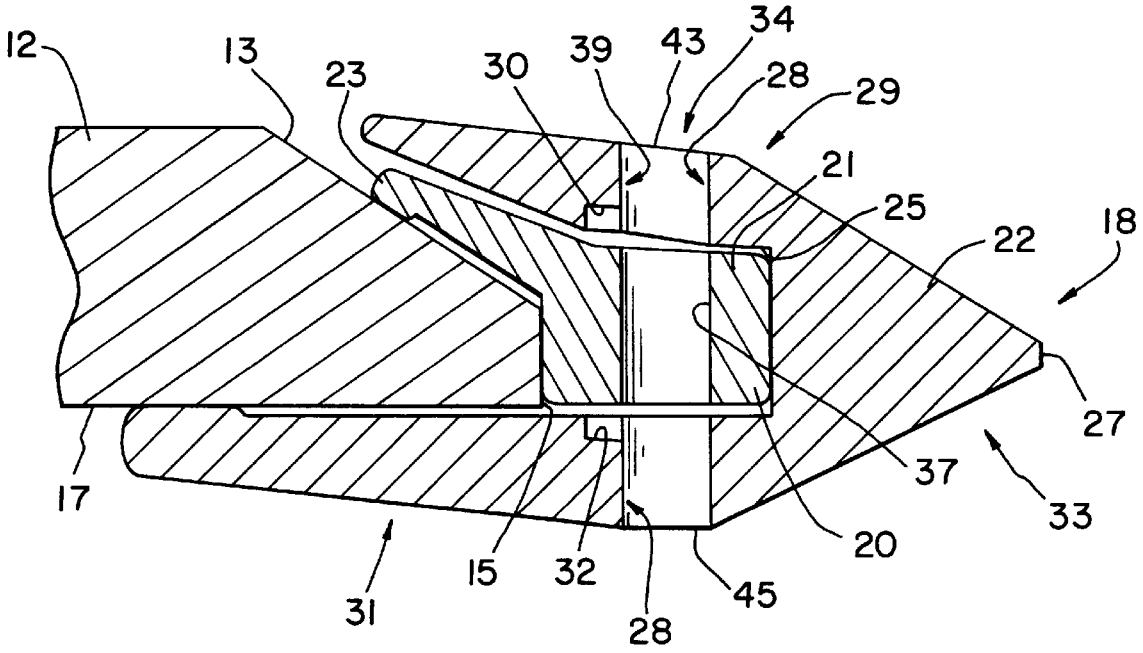
FIG. 4 is an enlarged cross sectional view of the edge protector assembly taken along the line 4—4 of FIG. 1 as viewed in the direction of the arrows, with a portion of the base edge shown for clarity of description, and with the fasten assemblies shown removed for clarity of description.

As shown in FIGS. 2, 3, and 4, base edge 12 has a beveled surface 13, an end portion 15 and an under portion 17. Edge protector assembly 18 includes a fixed component 20 (see FIGS. 3 and 4), a protection member 22 and a pair of fastening assemblies 36. Note that in FIG. 2, fastening assemblies 36 are shown positioned in second apertures 28, while in FIG. 4 the fastening assemblies 36 are removed for clarity of description.

Fixed component 20 has a rectangular portion 21 and an attachment arm 23. Rectangular portion 21 has a pair of first apertures 37 extending therethrough. Note that only one first aperture 37 is shown in FIG. 4. Fixed component 20 is secured to base edge 12 by welding rectangular member 21 to end portion 15, and welding attachment arm 23 to beveled surface 13.

Protection member 22 has an upper element 29, a lower element 31 and an exterior surface 33. Upper element 29 has a hood portion 24 and a lift ring 26 disposed thereon (see FIG. 2). Lift ring 26 aids in lifting and positioning protection member 22 relative to fixed component 20. Upper element 29 and lower element 31 are joined together to form a leading edge 27. Upper element 29 and lower element 31 define a receptacle 25 therebetween. Protection member 22 further includes a pair of second apertures 28 extending therethrough. Note that only one second aperture 28 is shown in FIG. 4. Both second apertures 28 are shown in FIG. 2.

Figure 5:
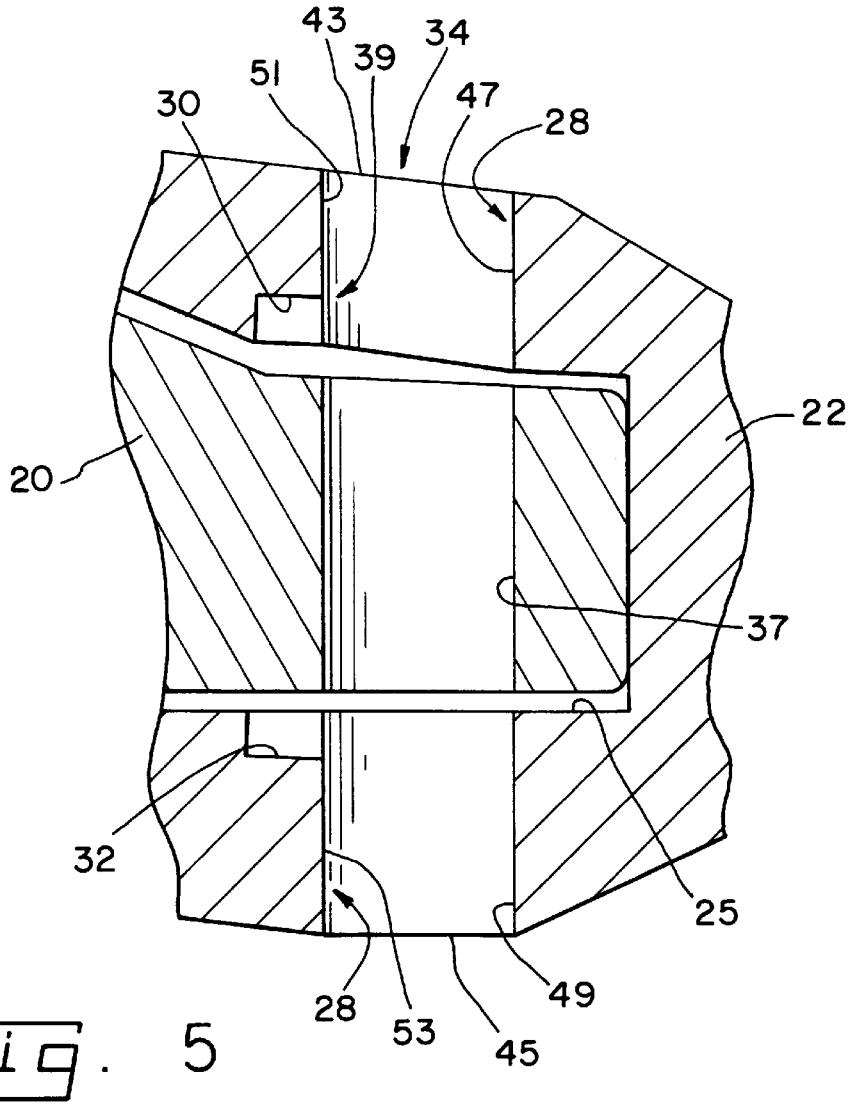
FIG. 5 is an enlarged view of the passageway shown in FIG. 4.

As shown in FIGS. 4 and 5, second aperture 28 includes a first opening segment 47 and a second opening segment 49. First opening segment 47 defines a first wall segment 51 of protection member 22. Second opening segment 49 defines a second wall segment 53 of protection member 22.

Protection member 22 is positioned relative to fixed component 20 such that fixed component 20 is disposed within receptacle 25. Protection member 22 is further positioned relative to fixed component 20 such that first opening segment 47 and second opening segment 49 of second aperture 28 cooperate with first aperture 37 of fixed component 20 to form a passageway 34 through edge protector assembly 18. Passageway 34 has a first end 43 and a second end 45. Passageway 34 also defines a passageway sidewall 39 extending between first end 43 and second end 45.

First wall segment 51 has a first notch 30 defined therein. First notch 30 is spaced apart from both first end 43 and second end 45 of passageway 34. Second wall segment 53 has a second notch 32 defined therein. Second notch 32 is spaced apart from both first end 43 and second end 45 of passageway 34.

Figure 12:
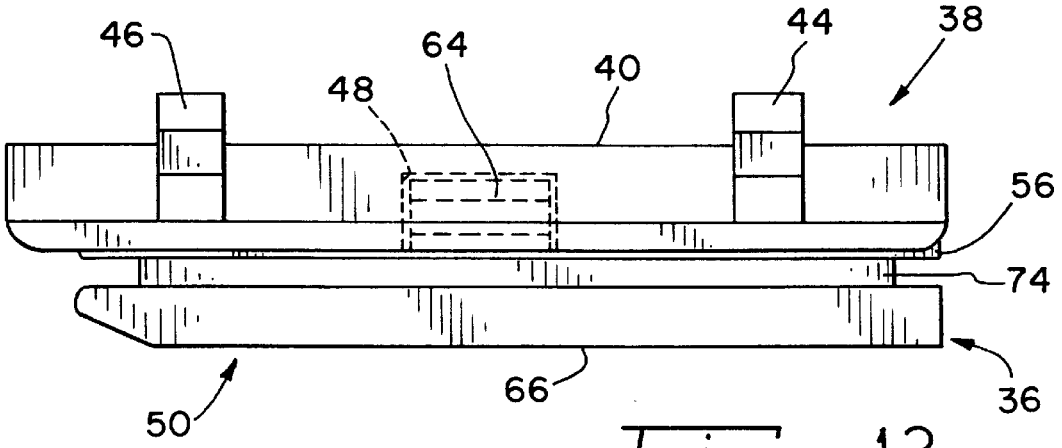
FIG. 12 is a side elevational view showing the cooperation between the pin member and the bearing member.

FIG. 12 shows in more detail the fastening assembly 36 that is positioned in the passageway 34 of FIG. 2. The fastening assembly 36 includes an elongated metallic bearing member 38 and a metallic pin member 50.

Figure 6:
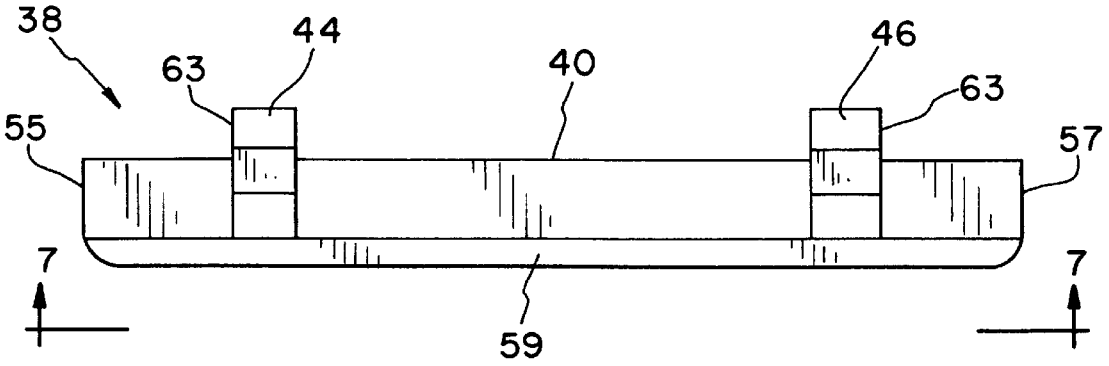
FIG. 6 is a side elevational view of a bearing member of the edge protector assembly of FIG. 2.
Figure 7:
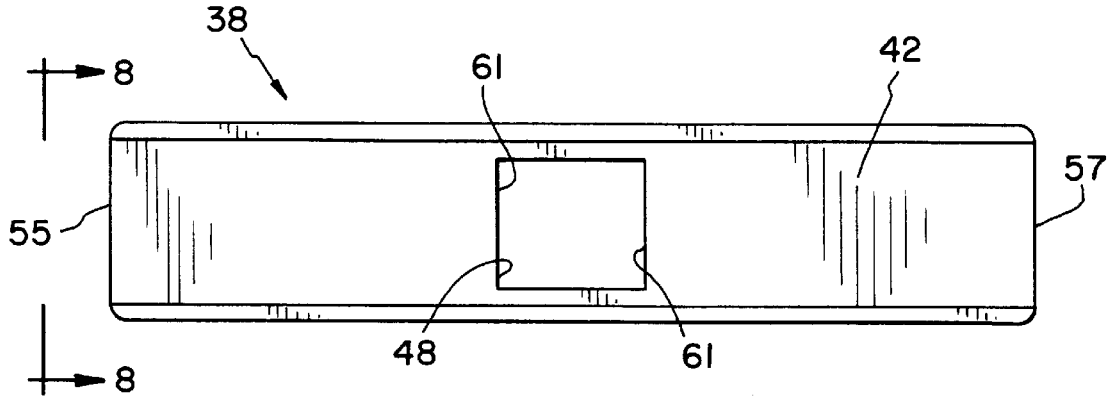
FIG. 7 is an elevational view of the bearing member taken along line 7—7 of FIG. 6 as viewed in the direction of the arrows.
Figure 8:
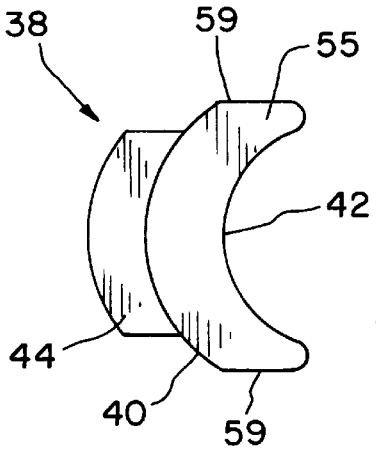
FIG. 8 is an end elevational view of the bearing member taken along line 8—8 of FIG. 7 as viewed in the direction of the arrows.

FIGS. 6, 7 and 8 show the bearing member in more detail. The bearing member 38 includes an upper end 55, a lower end 57 and a pair of edge wall portions 59. The bearing member 38 also includes a convex surface 40 interposed between edge wall portions 59 and extending between upper end 55 and lower end 57. The convex surface 40 is positioned in contact with the passageway sidewall 39 when the bearing member 38 is positioned within passageway 34. Bearing member 38 also has a concave surface 42 interposed between edge wall portions 59 and extending between upper end 55 and lower end 57.

Convex surface 40 has a first tab 44 and a second tab 46 extending therefrom. First tab 44 and second tab 46 define stop surfaces 63 thereon. Concave surface 42 has a cavity 48 formed therein which defines a pair of abutment portions 61 as shown in FIG. 7.

Figure 9:
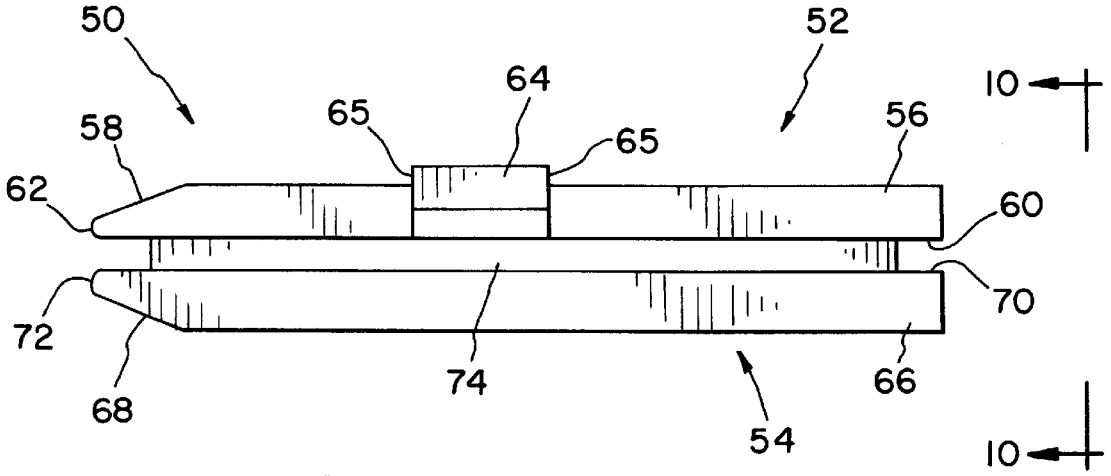
FIG. 9 is a side elevational view of a pin member of the edge protector assembly of FIG. 2.
Figure 10:
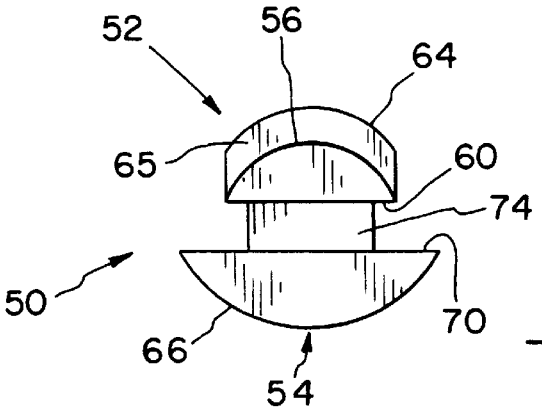
FIG. 10 is an end elevational view of the pin member taken along line 10—10 of FIG. 9 as viewed in the direction of the arrows.

Fastening assembly 36 also includes a pin member 50. As shown in FIGS. 9 and 10, the pin member 50 includes a first half 52 and a second half 54. First half 52 has a first semi-circular surface 56, a first planar surface 60 and a first angled portion 58. The first surface 56 is positioned in contact with the concave surface 42 of the bearing member 38 when the pin member 50 and bearing member 38 are located in passageway 34.

First angled portion 58 leads to a first pointed end 62, while second angled portion 68 leads to a second pointed end 72. First half 52 also includes a key 64 extending from first semi-circular surface 56. Key 64 defines check surfaces 65. It should be understood that first half 52 and second half 54 each have a thickness such that check surfaces 65 extend above first surface 56 to a significant height (e.g. about 3.0 millimeters), while still allowing pin member 50 to be inserted into passageway 34. Having check surfaces 65 extend to such a height ensures that key 64 does not slip out of cavity 48 during use of fastening assembly 36.

The second semi-circular surface 66 is positioned in contact with passageway sidewall 39 when the pin member 50 is located within the passageway 34. Semi-circular surface 66 is a smooth surface, i.e. substantially free from having any cavities, apertures, or the like defined therein. Having a smooth semi-circular surface 66 ensures that there is no positive engagement between semi-circular surface 66 and passageway sidewall 39. Having no positive engagement between these two elements facilitates the ability of pin member 50 to slide over passageway sidewall 39 and ensures that pin member 50 will move with, and thus remain stationary relative to, bearing member 38 when protection member 22 moves relative to fixed component 20.

Pin member 50 further includes a rectangular elastomeric load 74 secured between first half 52 and second half 54 as shown in FIGS. 9 and 10. The load 74 functions to spring bias the first half 52 and the second half 54 in an outwardly direction when the first half 52 and the second half 54 are compressed so as to be positioned in the passageway 34.

Figure 11:
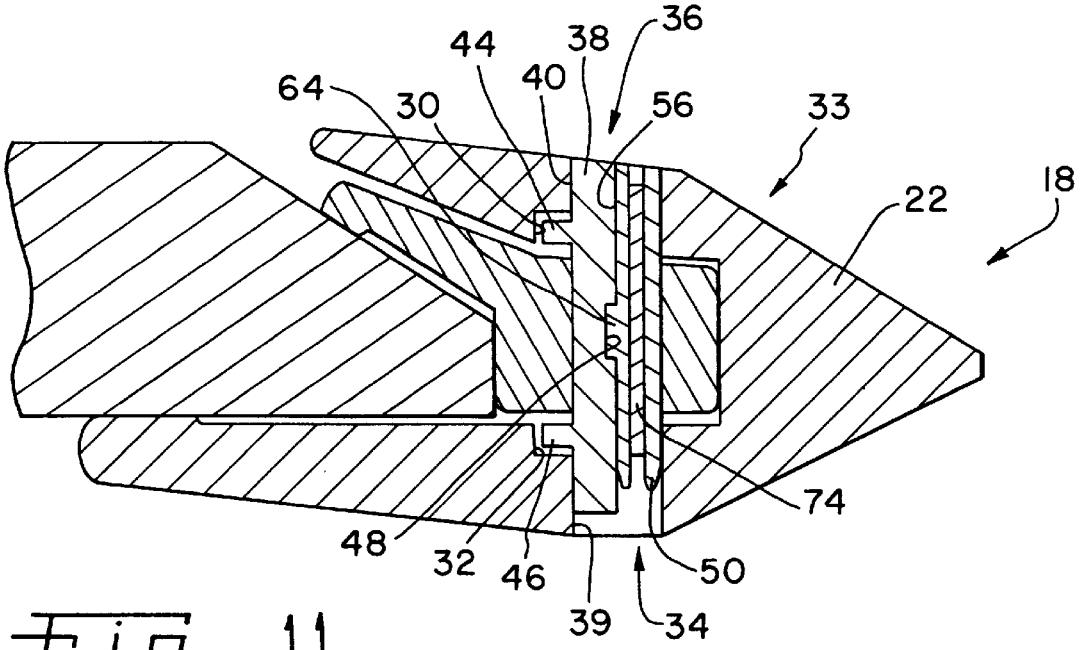
FIG. 11 is a view similar to FIG. 4 but showing the pin member and bearing member mounted in the passageway.

The installation of fastening assembly 36 to secure protection member 22 to fixed component 20 is described with reference to FIGS. 11 and 12. Bearing member 38 is positioned within passageway 34 such that convex surface 40 contacts passageway sidewall 39. Bearing member 38 is further positioned within passageway 34 until first tab 44 is positioned within first notch 30, and second tab 46 is positioned within second notch 32. As described above, first notch 30 and second notch 32 are each spaced apart both from first end 43 and second end 45 of passageway 34. Stop surfaces 63 of first and second tabs 44 and 46 (see FIG. 6) cooperate with first notch 30 and second notch 32 to maintain bearing member 38 in a substantially fixed position relative to protection member 22. It should be understood that having first notch 30, second notch 32, first tab 44 and second tab 46, spaced apart from first end 43 and second end 45 of passageway 34 in the manner described above facilitates the protection of these elements from the wear and tear experienced by exterior surface 33 during an excavating operation.

After the bearing member 38 is positioned as stated above, the pin member 50 is advanced within passageway 34 such that first semi-circular surface 56 is in contact with concave surface 42 (see FIG. 8) of bearing member 38. Pin member 50 is further advanced within passageway 34 such that key 64 is positioned within cavity 48 as shown in FIG. 12. Check surfaces 65 (see FIG. 9) cooperate with abutment surfaces 61 (see FIG. 7) of cavity 48 to maintain pin member 50 in a substantially fixed position relative to bearing member 38. Therefore, fastening assembly 36 is maintained in a substantially fixed position relative to protection member 22.

It should be understood that when pin member 50 is positioned within passageway 34, first half 52 and second half 54 are moved toward each other. Moving first half 52 and second half 54 toward each other compresses elastomeric load 74. Do to its resilient nature, compressed elastomeric load 74 continually urges second half 54 toward passageway sidewall 39. Similarly, key 64 is urged into cavity 48, first tab 44 is urged into first notch 30, and second tab 46 is urged into second notch 32. Thus, fastening assembly 36 is maintained in passageway 34, and protection member 22 remains secured to fixed component 20.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected. For example, while the attachment member is specifically described above as protection member 22, other attachment members can be secured to a bucket 11 utilizing fastening assembly 36. For example as shown in FIG. 1, a tooth assembly 76 can be secured to base edge 12 of bucket 11 utilizing fastening assembly 36. Moreover, a corner guard 78 can be secured to bucket 11 utilizing fastening assembly 36. It should be understood that fastening assembly 36 which secures tooth assembly 76 to bucket 11 would be inserted within a passageway which is defined in tooth assembly 76 and bucket 11 which is similar to that hereinbefore described with regard to passageway 34. Similarly, it should be understood that fastening assembly 36 which secures corner guard 78 to bucket 11 would be inserted within a passageway which is defined in corner guard 78 and bucket 11 which is similar to that hereinbefore described with regard to passageway 34.

I claim:

1. An apparatus for protecting a base edge of a bucket of an earth working machine, comprising:

a fixed component capable of being secured to said base edge of said bucket, said fixed component having a first aperture extending therethrough;

a protection member having a second aperture extending therethrough, wherein (1) said protection member is positioned relative to said fixed component such that said first aperture and said second aperture align to form a passageway having a first end and a second end, said passageway defining a passageway sidewall extending between said first end and said second end, (2) said protection member has a first notch defined therein, (3) said first notch is defined in said passageway sidewall, and (4) said first notch is spaced apart from both said first end and said second end of said passageway sidewall; and a bearing member having an outer surface extending between an upper end and a lower end thereof, said bearing member having a first tab extending from said outer surface such that a portion of said outer surface is interposed between said first tab and said upper end, wherein said bearing member is positioned within said passageway such that said first tab is positioned within said first notch and said portion of said outer surface is positioned in contact with said passageway sidewall.

2. The apparatus of claim 1, further comprising:

a pin member positioned within said passageway and in contact with said bearing member so as to maintain said first tab of said bearing member within said first notch of said protection member.

3. The apparatus of claim 1, wherein:

said second aperture includes a first opening segment and a second opening segment, said first opening segment defines a first wall segment of said protection member, said second opening segment defines a second wall segment of said protection member, said first wall segment of said protection member has said first notch defined therein, and said second wall segment of said protection member has a second notch defined therein.

4. The apparatus of claim 3, wherein:

said second notch is spaced apart from said first end and said second end of said passageway sidewall.

5. The apparatus of claim 4, wherein;

said bearing member has a second tab extending therefrom, said bearing is positioned in said passageway such that said second tab is positioned within said second notch.

6. The apparatus of claim 5, further comprising:

a pin member positioned within said passageway and in contact with said bearing member so as to maintain said first tab of said bearing member within said first notch of said protection member, wherein said pin member is positioned within said passageway and in contact with said bearing member so as to maintain said second tab of said bearing member within said second notch of said protection member.

7. The apparatus of claim 2, wherein:

said bearing member has a cavity formed therein, said pin member has a key extending therefrom, and said key is positioned within said cavity when said pin member is positioned within said passageway.

8. The apparatus of claim 7, wherein:

said pin member has a convex surface, said bearing member has a concave surface, said key extends from said convex surface of said pin member, said cavity is formed within said concave surface of said bearing member, and said concave surface of said bearing member is positioned in contact with said convex surface of said pin member when said pin member and said bearing member are both positioned within said passageway.

9. An earth working machine, comprising:

a bucket;

a fixed component secured to said bucket, said fixed component having a first aperture extending therethrough;

a protection member having a second aperture extending therethrough, wherein (1) said protection member is positioned relative to said fixed component such that said first aperture and said second aperture align to form a passageway having a first end and a second end, said passageway defining a passageway sidewall extending between said first end and said second end, (2) said protection member has a first notch defined therein, (3) said first notch is defined in said passageway sidewall, and (4) said first notch is spaced apart from both said first end and said second end of said passageway sidewall; and a bearing member having an outer surface extending between an upper end and a lower end thereof, said bearing member having a first tab extending from said outer surface such that a portion of said outer surface is interposed between said first tab and said upper end, wherein said bearing member is positioned within said passageway such that said first tab is positioned within said first notch and said portion of said outer surface is positioned in contact with said passageway sidewall.

10. The apparatus of claim 9, further comprising:

a pin member positioned within said passageway and in contact with said bearing member so as to maintain said first tab of said bearing member within said first notch of said protection member.

11. The apparatus of claim 9, wherein:

said second aperture includes a first opening segment and a second opening segment, said first opening segment defines a first wall segment of said protection member, said second opening segment defines a second wall segment of said protection member, said first wall segment of said protection member has said first notch defined therein, and said second wall segment of said protection member has a second notch defined therein.

12. The apparatus of claim 11, wherein:

said second notch is spaced apart from said first end and said second end of said passageway sidewall.

13. The apparatus of claim 12, wherein;

said bearing member has a second tab extending therefrom, said bearing member is positioned in said passageway such that said second tab is positioned within said second notch.

14. The apparatus of claim 13 further comprising:

a pin member positioned within said passageway and in contact with said bearing member so as to maintain said first tab of said bearing member within said first notch of said protection member, wherein said pin member is positioned within said passageway and in contact with said bearing member so as to maintain said second tab of said bearing member within said second notch of said protection member.

15. The apparatus of claim 10, wherein:

said bearing member has a cavity formed therein, said pin member has a key extending therefrom, and said key is positioned within said cavity when said pin member is positioned within said passageway.

16. The apparatus of claim 15, wherein:

said pin member has a convex surface, said bearing member has a concave surface, said key extends from said convex surface of said pin member, said cavity is formed within said concave surface of said bearing member, and said concave surface of said bearing member is positioned in contact with said convex surface of said pin member when said pin member and said bearing member are both positioned within said passageway.

17. A fastening assembly for securing an attachment member to a bucket of an earth working machine, with (1) said bucket having a first aperture defined therein, and (2) said attachment member having a second aperture defined therein, comprising:

a bearing member positionable within said first aperture and said second aperture, wherein said bearing member has (1) has a first end and a second end, (2) a tab extending therefrom at a location intermediate said first end and said second end of said bearing member, and (3) a cavity formed therein, and a pin member positionable within said first aperture and said second aperture, wherein (1) said pin member has a key extending therefrom which is positioned within said cavity of said bearing member, (2) an external sidewall of said pin member contacts both a first internal sidewall of said first aperture and a second internal sidewall of said second aperture when said pin member is positioned within said first aperture and said second aperture, and (3) said external sidewall of said pin member defines a linear surface which contacts both said first internal sidewall of said first aperture and said second internal sidewall of said second aperture.

18. The fastening assembly of claim 17, wherein:

said pin member has a convex surface, said bearing member has a concave surface, said key extends from said convex surface of said pin member, said cavity is formed within said concave surface of said bearing member, and said concave surface of said bearing member is positioned in contact with said convex surface of said pin member when said pin member and said bearing member are both positioned within said first aperture and said second aperture.

* * * * *